US006227762B1

(12) United States Patent
Van Velsor

(10) Patent No.: US 6,227,762 B1
(45) Date of Patent: May 8, 2001

(54) PAVING APPARATUS AND METHOD

(76) Inventor: Wesley Van Velsor, P.O. Box 213, Charlestown, NH (US) 03603

( * ) Notice: Subject to any disclaimer, the term of this patent is extended or adjusted under 35 U.S.C. 154(b) by 0 days.

(21) Appl. No.: 09/146,837

(22) Filed: Sep. 3, 1998

(51) Int. Cl.[7] ..... E01C 23/14
(52) U.S. Cl. ..... 404/95; 404/79; 404/77
(58) Field of Search ..... 404/77, 79, 95, 404/27; 280/504, 511, 478.1

(56) References Cited

U.S. PATENT DOCUMENTS

| | | | | |
|---|---|---|---|---|
| 1,677,600 | * | 7/1928 | Schutte | 404/27 |
| 3,970,404 | * | 7/1976 | Benedetti | 404/77 |
| 3,997,276 | * | 12/1976 | Jackson, Sr. | 404/77 |
| 4,601,605 | * | 7/1986 | Damp et al. | 404/95 |
| 4,969,772 | * | 11/1990 | Chiba et al. | 404/95 |
| 5,188,481 | * | 2/1993 | O'Brien | 404/95 |
| 5,839,829 | * | 11/1998 | Litvin et al. | 374/121 |
| 5,857,693 | * | 1/1999 | Clark, Jr. | 280/415.1 |
| 5,890,727 | * | 4/1999 | May | 280/416.1 |
| 5,895,172 | * | 4/1999 | Grembowicz et al. | 404/79 |
| 5,899,630 | * | 5/1999 | Brock | 404/79 |
| 5,975,553 | * | 11/1999 | Van Vleet | 280/483 |
| 6,070,679 | * | 6/2000 | Berg et al. | 180/19.2 |

* cited by examiner

*Primary Examiner*—Eileen D. Lillis
*Assistant Examiner*—Raymond W Addie

(74) *Attorney, Agent, or Firm*—Michael J. Persson; Lawson, Philpot & Persson

(57) ABSTRACT

A method of preparing an asphalt edge for joining and a two part joint heating system for use in carrying out the method. In it most basic form, the method of the present invention includes the steps of placing a first layer of asphalt in a roadway and allowing the first layer of asphalt to cool to a temperature below a predetermined minimum bonding temperature. The surface of the joining area of the first layer is then preheated to a temperature above the minimum bonding temperature but below the ignition temperature of the asphalt. The remainder of the joining area of the first layer is then allowed to absorb the heat from the surface. After a predetermined period of time is allowed for absorption of heat, the surface of the joining area of the first layer of asphalt is again heated to a temperature below the ignition temperature of the asphalt and the second layer of asphalt is placed adjacent to the first layer such that a joint is formed between the first layer and the second layer. In the preferred method, the first layer of asphalt is maintained between a minimum bonding temperature of 275° Fahrenheit and below a danger temperature of 325° Fahrenheit. The preferred method also includes the step of scarifying a portion of the first layer after the heating step and before the second layer of asphalt is placed adjacent to the first layer. The joint heating system of the present invention comprises a mobile pre-heater for preheating the first layer at the joining area and a paver that includes a paver mounted heater for heating the joining area prior to placing the second layer of asphalt adjacent to the first layer.

11 Claims, 4 Drawing Sheets

PAVING APPARATUS AND METHOD

FIELD OF THE INVENTION

The present invention relates to the field of asphalt paving and, in particular, to an apparatus and method for increasing the durability of asphalt paving joints.

BACKGROUND OF THE INVENTION

Over the past thirty years, asphalt has replaced concrete as the material of choice for paving roadways. Asphalt provides a smooth road surface that is easier to apply and easier to resurface than concrete. However, asphalt pavers generally cannot pave an entire road surface in a single pass and therefore joints must be formed between the previously placed asphalt and the newly placed asphalt being placed by the paver. It is at these joints that asphalt is most susceptible to failure as the "cold", previously placed, asphalt is not sufficiently heated by the hot asphalt from the paver to form a homogenous bond at the joint. These non-homogenous "cold joints" often will separate and create cracks, most usually in the center of two lane roads, which allows water to enter the pavement, migrate to the road base and, over a period of time, contribute substantially to base failure of the road.

To overcome this problem, the previously placed pavement joint, must be heated to approximately the same temperature as the new material that is being placed to provide the proper environment for thermal bonding. However, the chemical properties of asphalt make this a difficult task. First, asphalt is a petroleum based product and has a tendency to burn if overheated. Second, the mass and thermal conductivity of asphalt necessitate heating the asphalt for a significant period of time to raise the temperature of the entire asphalt layer to the desired bonding temperature. The combination of these properties makes traditional heating by propane torch, either hand-held or paver-mounted, an ineffective and dangerous exercise.

When paver-mounted heaters are used to preheat the asphalt, the temperature of the burning propane raises the temperature of the top layer of asphalt to its burning temperature well before the remainder of the asphalt layer has reached its desired bonding temperature. Thus, to avoid igniting the top of the asphalt layer, the paver must move before the entire layer is sufficiently heated, bonding the new hot asphalt to "warm" asphalt. This increases the adhesion somewhat, but does not provide the durability of a true "hot joint". When hand held heaters are used, the heat to the pavement may be cycled to allow proper heating of the entire layer. However, the risk of fire increases with this approach as the exposure of the heater to the pavement is controlled by the operator. In addition, the use of hand held heaters requires additional manpower and slows the paving process.

A method or apparatus for joining a newly paced layer of asphalt to a previously placed layer of asphalt that creates a durable and substantially homogenous "hot joint", that does not create a risk of fire, that does not require additional manpower, and that allows asphalt to be placed in a substantially continuous process, is not known in the art.

SUMMARY OF THE INVENTION

The present invention is method of preparing an asphalt edge for joining and a two part joint heating system for use in carrying out the method. In it most basic form, the method of the present invention includes the steps of placing a first layer of asphalt in a roadway and allowing the first layer of asphalt to cool to a temperature below a predetermined minimum bonding temperature. The surface of the joining area of the first layer is then preheated to a temperature above the minimum bonding temperature but below the ignition temperature of the asphalt. The remainder of the joining area of the first layer is then allowed to absorb the heat from the surface. After a predetermined period of time is allowed for absorption of heat, the surface of the joining area of the first layer of asphalt is again heated to a temperature below the ignition temperature of the asphalt and the second layer of asphalt is placed adjacent to the first layer such that a joint is formed between the first layer and the second layer. In the preferred method, the first layer of asphalt is maintained between a minimum bonding temperature of 275° Fahrenheit and below a danger temperature of 325° Fahrenheit. The preferred method also includes the step of scarifying a portion of the first layer after the heating step and before the second layer of asphalt is placed adjacent to the first layer.

The preferred heating system includes one twelve foot infrared heater attached to the side of the paver and a mobile pre-heater "train" composed of several twelve foot infrared joint heating units pulled by a motorized vehicle equipped with hydrostatic transmission to precede the paver and to travel at the same rate of speed as the paver. By assembling the proper number of pre-heater units to accommodate the speed of the paver, ambient temperature, and weather conditions, the proper heat penetration can be assured; with two to three preheat units being sufficient for most paving conditions. It is also preferred that both the mobile preheater and the paver-mounted heater include sensors for controlling the burners to eliminate the possibility of damage to the pavement if the paver stops or slows down.

In some embodiments of the system, a small rake is attached to the rear of the paver mounted heater, but still located beneath the infrared heater and is adjusted to scarify the joint to a depth of one half inch. This provides a clean joint free of foreign matter and acts to disperse any surface glaze that may develop when heating the joint. In these embodiments, it is important that the rake is maintained at a temperature equal to or greater than the asphalt to prevent the asphalt from sticking to the rake.

Therefore, it is an aspect of the invention to provide a system by which asphalt pavement can be placed in such a way that cold joints can be avoided.

It is a further aspect of the invention to provide a system to heat pavement joints at the time of placing adjacent and abutting sections of pavement.

It is a further aspect of the invention to provide a heating system that will penetrate to a depth sufficient to achieve proper and permanent bonding to an adjacent course of asphalt pavement.

It is a further aspect of the invention to provide a heating system for heating cold joints that will not burn or damage the asphalt pavement.

It is a further aspect of the invention to provide a means of cleaning (scarifying) the edge of previously placed pavement to assure better bonding.

It is a further aspect of the invention to provide a heating system which will supply adequate heat penetration to increase compaction at joint.

It is a further aspect of the invention to provide a system that will heat properly at any paving speed.

It is a further aspect of the invention to provide a joint heater that will be automatically controlled to eliminate human error and not be a burden to the paver operator.

It is a further aspect of the invention to provide a system that is fuel efficient.

It is a further aspect of the invention to provide a system that is easy to work on with little maintenance involved.

It is a still further aspect of the invention to provide pre-heater units that are easy to transport from job to job.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE DRAWINGS

Figure 1:
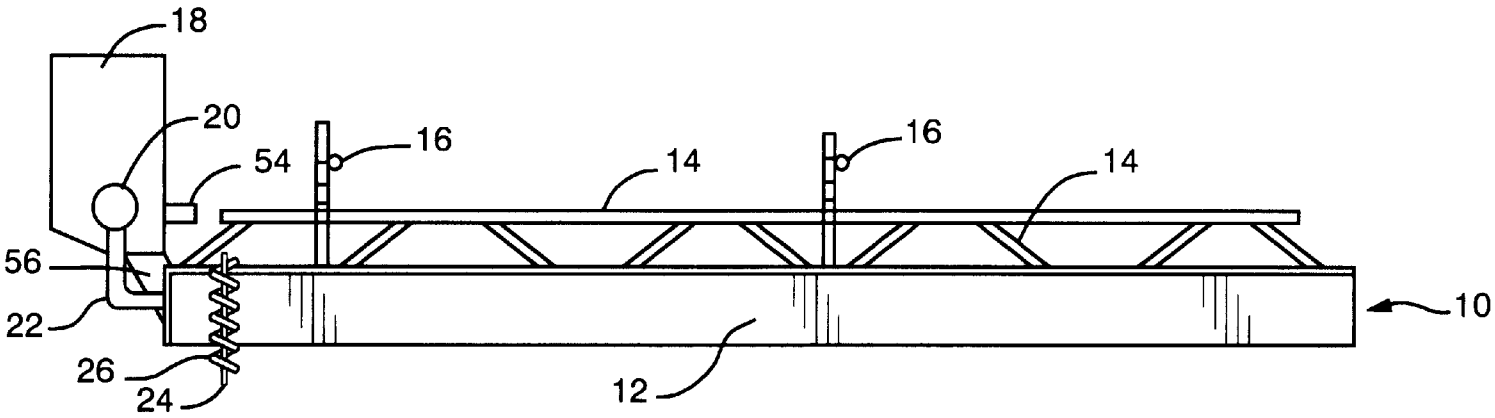
FIG. 1 is a side view of the preferred paver mounted heater of the system of the present invention.

The method of the present invention is a product of considerable research into effects of preheating on asphalt joints. This research has revealed that a more durable "hot" joint may be formed between layers of asphalt by preheating an edge portion of the surface of a first layer of asphalt to predetermined temperature and allowing that heat to penetrate through the first layer before heating again and placing a second layer adjacent to the first layer.

The preferred method of the present invention begins with the step of placing the first layer of asphalt in the road bed. As discussed previously, this is accomplished using standard paving equipment and produces a layer of asphalt covering a portion of the road bed. Typically, the paver will place the first layer along a long stretch of roadway in a single pass before placing the second layer adjacent to the first layer. Thus, the first layer is allowed to cool to a temperature well below 275° Fahrenheit during the normal process of paving. However, even in cases where short stretches are paved, the first layer of asphalt will generally cool to a temperature below 275° Fahrenheit before the second layer is placed and consequently require additional pre-heating to create a "hot" joint.

Once the first layer is cooled, it is preferred that the system of the present invention be utilized to create the desired "hot" joint between the first and second layer of asphalt. The system of the present invention utilizes a mobile pre-heater to pre-heat the surface of the first layer of asphalt within a predetermined temperature range. As discussed further with reference to FIGS. 4–6, the preferred pre-heater is a propane fired infrared heater mounted to a wheeled trailer and dimensioned to be pulled by a tractor or other vehicle. Depending upon the composition of the asphalt and the ambient conditions, multiple pre-heaters may be attached in series and utilized to pre-heat the first layer of asphalt.

Pre-heating is accomplished by disposing the pre-heater a fixed distance in front of the paver and conveying the pre-heater at substantially the same speed as the paver. The spacing between the pre-heater and paver is critical to the effectiveness of the system as the time allowed between pre-heating and heating the first layer with the paver mounted heater must be sufficient to allow penetration of the heat throughout the first layer while not allowing the first layer to cool such that the paver-mounted heater cannot heat the first layer to within the desired temperature range for joining; between 275° Fahrenheit and 325° Fahrenheit in the preferred embodiment. As it is a characteristic of asphalt pavement to absorb and release heat slowly, the spacing between the pre-heater and paver allows the heat from the pre-heater to penetrate to its maximum depth before the approach of the paver-mounted heater. Because the pavement is warmed to the desired depth by the pre-heater, the heat from the paver mounted heater is able to penetrate more rapidly and to a greater depth, producing a suitable environment for hot joining. Utilizing typical pavers travelling at typical paving speeds at ambient temperatures of between 40 and 90 degrees Fahrenheit, it has been found that a spacing of 100 feet between the pre-heater(s) and paver is preferred.

The paver follows the pre-heater and includes a paver-mounted heater for heating the asphalt to the desired temperature range before placing the second layer of asphalt adjacent to the first layer. As described in greater detail with respect to FIGS. 1–3, paver-mounted heater is attached to the paver such that it heats the joining area of the first layer of asphalt immediately before the second layer is placed by the paver. In the preferred method, the joining area of the first layer is scarified by a rake assembly after heating by the paver-mounted heater but before the second layer is placed. Once heated to the desired temperature range, the second layer of asphalt is placed adjacent to the first layer such that a joint is formed. The resulting "hot joint" has been found to be more durable than "cold joints". Further, the preferred system allows the method to be performed in a continuous process requiring fewer people and increasing safety substantially.

Figure 2:
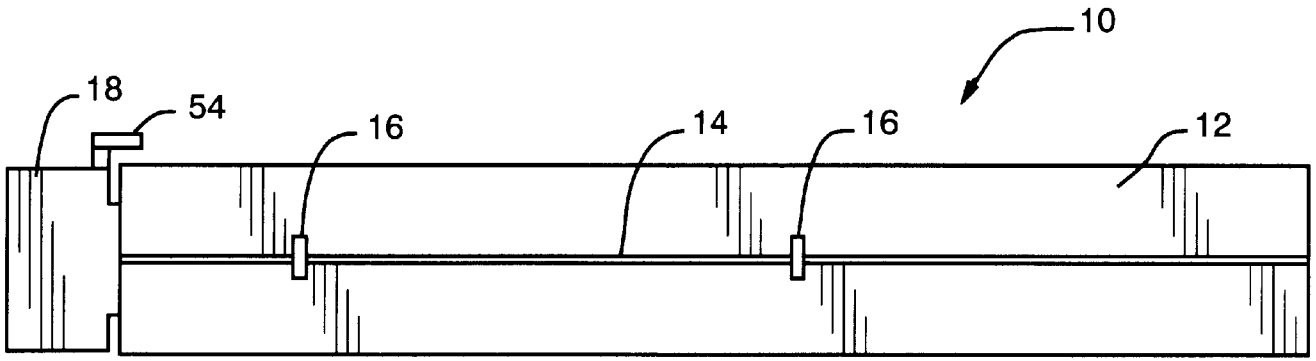
FIG. 2 is a top view of the preferred paver mounted heater of the system of the present invention.
Figure 3:
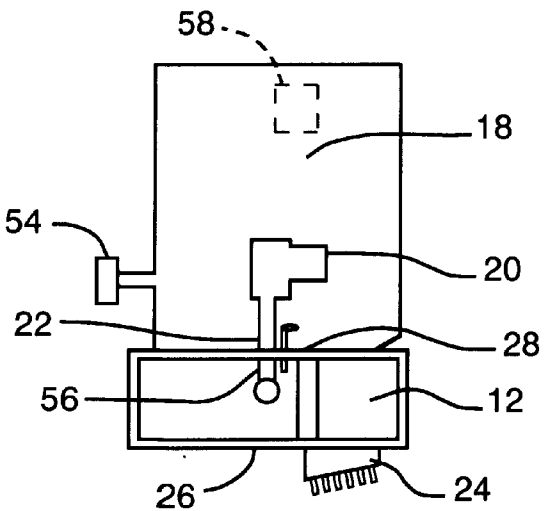
FIG. 3 is a rear view of the preferred paver mounted heater of the system of the present invention.

Referring now to FIGS. 1–3 the preferred paver-mounted heater 10 of the system of the present invention is shown. The paver-mounted heater 10 is attached to the paver (not shown) by two paver mounting brackets 16. The paver mounting brackets 16 are designed to attach to two pipe/rod hangers (not shown) projecting horizontally from the paver. Attaching the paver mounted heater 10 to the paver is quickly accomplished by simply placing the paver mounting brackets 16 over hangers, sliding the paver mounting brackets 16 into position, and tightening locking bolts. The paver mounting bracket 16 is also designed to allow the height of the paver mounted heater 10 to be adjusted relative to the pavement to be heated.

Infrared chamber 12 is attached to paver mounting brackets 16 and preferably contains four infrared energy converters, such as those manufactured by Ray-Tech Infrared Corporation of Charlestown, N.H. Infrared chamber is preferably 15 inches wide by 154 inches long. Because of the significant distance between the most forward paver mounting bracket 16 and the front of the infrared chamber 12, a truss design chamber bracing support 14 is utilized in the preferred embodiment to provide the necessary rigidity of the chamber 12. The chamber bracing support 14 is preferably a steel fabricated truss and is designed to support the forward portion of the Infrared chamber 12 which protrudes beyond the front of the paver, thus affording no direct support from the paver at that point. In embodiments utilizing the chamber bracing support 14, paver mounting brackets 16 are preferably attached to the bracing support 14 rather than directly to the infrared chamber 12 to provide additional rigidity to the attachment.

The control box 18 contains all necessary controls, valves, switches, and the like to operate the chamber 12. An electronic igniter 56 is controlled by the control box 18 based upon signals from the sensor system 54. The preferred sensor system 54 is an infrared sensor system which includes an infrared heat sensing device that measures the temperature of the asphalt and generates and output signal that is sent to the control box 18. This infrared sensor system 54 is preferably mounted near the paver mounted heater and positioned in such a way as to permit the infrared sensor 54 to "view" the pavement in front of the rake 24 at the rear of the chamber 12. The information from the infrared sensor 54 is analyzed to determine if the temperature of the existing asphalt is above a predetermined danger level which is less than the ignition temperature of the asphalt, 325° Fahrenheit in the preferred embodiment. If the temperature is above this danger level, a signal is sent to the control box 18 to turn the heater off. When the temperature drops below the minimum preferred bonding temperature, 275° Fahrenheit in the preferred embodiment, a signal is sent to the control system to pressurize the manifold with gas and air and activate the electric igniter 56, turning the heater back on. Utilizing the preferred paver heater 10, this process takes approximately five to seven seconds.

The blower motor 20 mixes propane fuel with air and delivers the mixture, under pressure, through the manifold 22 to the infrared converters in the chamber 12 to provide uniform heating. The fuel is stored on the deck of the paver and carried via flexible hose to the blower motor 20. Electrical power to the blower motor 20 and control box 18 is preferably provided by a 115 volt generator mounted on the paver, with a 12 volt transformer 58 transforming this power for operating the electronic igniter 56 and various other controls. However, in other embodiments, power is supplied via a cable connection to the paver's electrical system.

The rake 24, shown mounted under the rear of the chamber 12 in FIGS. 1 and 3, is mounted directly to, or supported from, the chamber 12. Rake 24 is held in place by an adjustable rake bracket 26, and is preferably mounted to the rear of the infrared sensor 54 and in front of the paver screed (not shown). The rake bracket 26 will be properly reinforced and secured to the chamber 12 to provide the proper positioning of the rake 24. To provide a more precise depth of penetration of the asphalt, rake 24 is preferably controllable via a lead screw 28 having a handle on its top end to allow the height of the rake 24 to be adjusted manually. Due to anticipated wear, the rake 24 is preferably mounted for easy replacement. In addition, the preferred rake 24 includes an induction or other heater (not shown) that heats the rake to a temperature sufficient to eliminate bonding of asphalt to the rake 24.

Figure 6:
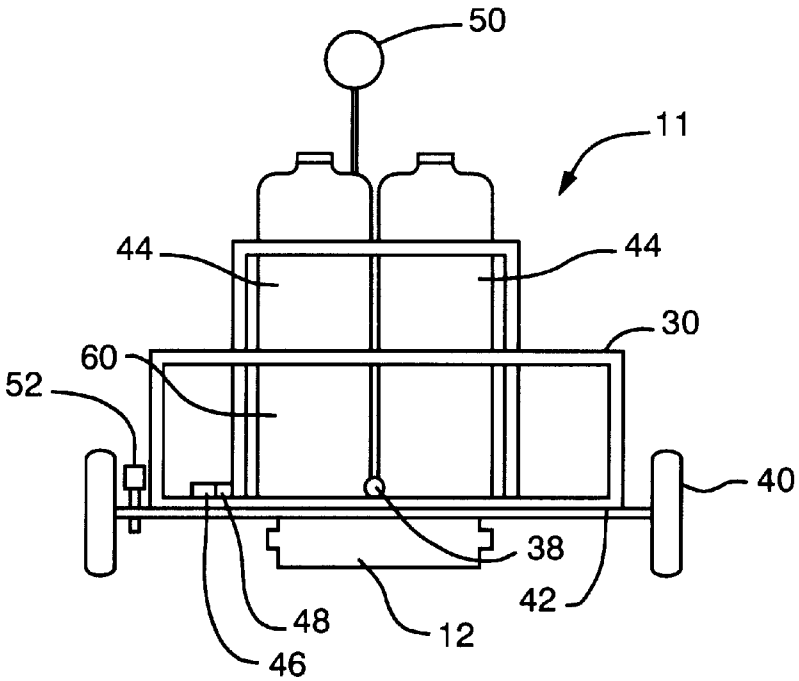
FIG. 6 is a rear view of the preferred pre-heater of the system of the present invention.
Figure 4:
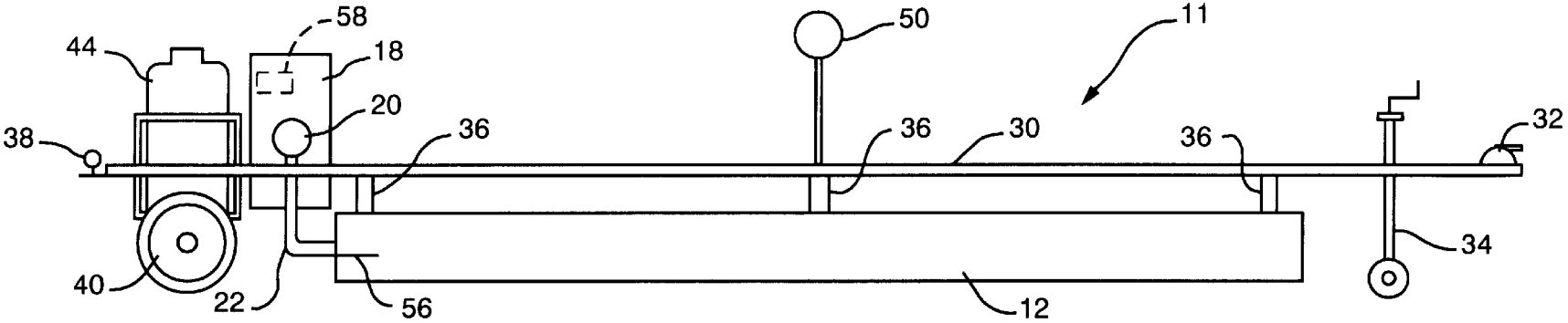
FIG. 4 is a side view of the preferred pre-heater of the system of the present invention.
Figure 5:
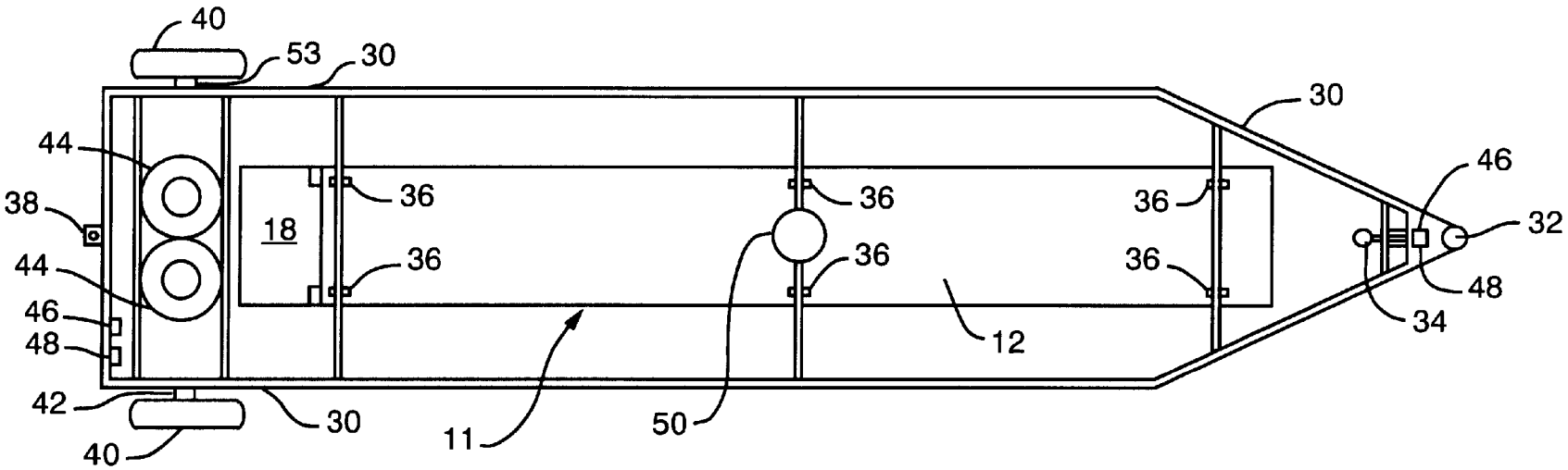
FIG. 5 is a top view of the preferred pre-heater of the system of the present invention.

FIGS. 4–6 show the pre-heater 11. As discussed above with respect to the method of the present invention, pre-heater 11 is a mobile, or trailer mounted, unit that is disposed a predetermined distance in front of the paver and conveyed at substantially the same speed as the paver in order to maintain a substantially constant amount of time between pre-heating and heating by the paver mounted heater.

Pre-heater 11 is similar in all respects to the paver mounted heater 10 except that the pre-heater is adapted for mobile, rather than fixed, operation. The chamber 12 is the same basic chamber as the paver mounted heater 10, but preferably does not include the chamber mounting support 14 of FIGS. 1–3. Instead, the chamber 12 is suspended from the trailer frame 30 by six adjustable chamber hangers 36. The blower motor 20, manifold 22 and control box 18 are the same as the paver mounted unit. Fuel to the motor 20 is provided by two trailer mounted propane tanks 44.

Because the pre-heater 11 is designed to be connected in multiple units hitched together in series, the trailer is preferably equipped with a the front trailer hitch coupler 32 mounted to the front of the frame 30 and a hitch ball 38 mounted to the rear of the frame 30. In the preferred embodiment, two wheels 40 are located at the rear of the unit and a swing way jack with wheel 34 is mounted at the front of the unit to allow easy movement of the trailer. It is preferred that wheels 40 be heat resistant to at least 275° F. to prevent degradation due to normal use of the pre-heater 11.

To prevent ignition of the asphalt due to a slowing or stoppage of the pre-heater, a sensor is included on the pre-heater 11 to send a signal to the control box 18 when a predetermined condition is met. In the preferred embodiment, this sensor is a wheel rotation sensor 52 that senses the rotation of the wheels 40 of the trailer and sends a signal to the control box 18 prompting the infrared chamber 12 to shut down when the wheels slow to a speed that will allow the asphalt to be heated above the danger level. However, other temperature sensors, such as those discussed with reference to the preferred paver mounted heater 10, are utilized in other embodiments to maintain the temperature of the asphalt within the desired temperature range.

In some embodiments, a flashing light 50 is mounted on a post at a height and location to be determined by the user to enhance visual contact between the paver and pre-heater and to enhance visibility to motorists passing the paving crew. A 110 volt trailer connector 46 and a 12 volt trailer connector 48 are located at each end of the trailer to provide electrical power to all trailers. The 110 volt power is preferably provided by a generator mounted in the towing vehicle while the 12 volt power is preferably provided through a transformer in the control box 18. In these embodiments, a 12 volt trailer connector 48 is also included on each end of the trailer for emergency use if a transformer should malfunction.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A method of joining layers of asphalt comprising the steps of:

placing a first layer of asphalt in a roadway:

allowing said first layer of asphalt to cool to a temperature below a predetermined minimum bonding temperature;

preheating a surface of a joining area of said first layer of asphalt to a temperature between the predetermined minimum bonding temperature and a predetermined danger temperature, said danger temperature being below an ignition temperature of said asphalt;

allowing said joining area of said first layer of asphalt to absorb heat from said surface of said joining area of said first layer of asphalt;

reheating said surface of said joining area of said first layer of asphalt such that said joining area is heated to a temperature between the predetermined minimum bonding temperature and the predetermined danger temperature; and placing a second layer of asphalt in said roadway adjacent said first layer of asphalt such that a hot joint is formed between said first layer and said second layer.

2. The method as claimed in claim 1 wherein said predetermined minimum bonding temperature is 275° Fahrenheit.

3. The method as claimed in claim 1 wherein said predetermined danger temperature is 325° Fahrenheit.

4. The method as claimed in claim 1 further comprising the step of scarifying at least a portion of said joining area of said first layer of asphalt prior to placing said second layer of asphalt in said roadway.

5. The method as claimed in claim 4 wherein said predetermined minimum bonding temperature is 275° Fahrenheit and said predetermined danger temperature is 325° Fahrenheit.

6. A pre-heater for preheating a portion of a layer of asphalt prior to joining with another layer of asphalt, said pre-heater comprising:

a mobile trailer for attachment to a vehicle, said mobile trailer comprising a frame having a front and a rear, a front trailer hitch coupler mounted to said front of said frame, and a rear hitch ball mounted to said rear of said frame;

an infrared chamber attached to said mobile trailer for generating heat;

a control box in electrical communication with said infrared chamber, said control box comprising controls for controlling said infrared chamber; and a sensor in electrical communication with said control box for sending a signal to said control box such that a temperature of said portion of said layer of asphalt is maintained below a predetermined danger temperature, wherein said sensor is a temperature sensor for sensing a temperature of a surface of said portion of said asphalt layer and sending a signal to said control box when said temperature exceeds a predetermined danger temperature;

wherein said infrared chamber is conveyed upon said trailer by the vehicle and controlled by said control box such that said portion of said layer of asphalt is heated to a temperature below said predetermined danger temperature of said asphalt.

7. The pre-heater as claimed in claim 6 wherein said sensor is further adapted to send a signal to said control box when said temperature drops below a predetermined minimum bonding temperature and wherein said control box is adapted to activate said infrared chamber upon receipt of said signal.

8. A system for joining a second layer of asphalt to a first layer of asphalt, said system comprising:

a pre-heater for preheating a joining area of said first layer of asphalt prior to joining with said second layer of asphalt, said pre-heater comprising;

a mobile trailer for attachment to a vehicle, said mobile trailer comprising a frame having a front and a rear, a front trailer hitch coupler mounted to said front of said frame, and a rear hitch ball mounted to said rear of said frame, an infrared chamber attached to said mobile trailer for generating heat;

a control box in electrical communication with said infrared chamber, said control box comprising controls for controlling said infrared chamber; and a pre-heater sensor in electrical communication with said control box for sending a signal to said control box such that a temperature of said portion of said layer of asphalt is maintained below a predetermined danger temperature, wherein said pre-heater sensor is a temperature sensor for sensing a temperature of a surface of said portion of said asphalt layer and sending a signal to said control box when said temperature exceeds a predetermined danger temperature; and a paver for placing said second layer of asphalt adjacent to said first layer of asphalt, said paver comprising;

a paver mounted heater attached to a front of said paver, said paver mounted heater comprising;

an infrared chamber attached to said paver for generating heat;

a control box in electrical communication with said infrared chamber, said control box comprising controls for controlling said infrared chamber; and a paver mounted heater sensor in electrical communication with said control box for sending a signal to said control box such that a temperature of said portion of said layer of asphalt is maintained between a predetermined minimum bonding temperature and a predetermined danger temperature;

wherein said first layer of asphalt is placed in a roadway and allowed to cool to a temperature below a predetermined minimum bonding temperature, said pre-heater is disposed across said first layer to preheat a surface of a joining area of said first layer to a temperature between the predetermined minimum bonding temperature and the predetermined danger temperature, said joining area is allowed to absorb heat from said surface of said joining area, said paver mounted heater heats said surface of said first layer to a temperature between the predetermined minimum bonding temperature and the predetermined danger temperature, and said second layer of asphalt is placed in said roadway adjacent said first layer of asphalt such that a joint is formed between said first layer and said second layer.

9. The system as claimed in claim 8 wherein said paver mounted heater further comprises a rake for scarifying said joint area of said first layer of asphalt.

10. The system as claimed in claim 8 wherein said pre-heater sensor is further adapted to send a signal to said control box when said temperature drops below a predetermined minimum bonding temperature and wherein said control box is adapted to activate said infrared chamber of said pre-heater upon receipt of said signal.

11. The system as claimed in claim 9 wherein said paver mounted heater sensor is a temperature sensor for sensing a temperature of a surface of said portion of said asphalt layer and sending a first signal to said control box when said temperature exceeds a predetermined danger temperature and a second signal to said control box when said temperature drops below a predetermined minimum bonding temperature.

* * * * *